United States Patent [19]

Loeber et al.

[11] Patent Number: 5,065,814

[45] Date of Patent: Nov. 19, 1991

[54] REDUCED NOISE MODULAR COOLING SYSTEM

[75] Inventors: Frederick W. Loeber, Tulsa; George O. Greene, Glenpool, both of Okla.

[73] Assignee: Terex Corporation, Green Bay, Wis.

[21] Appl. No.: 607,915

[22] Filed: Nov. 1, 1990

[51] Int. Cl.[5] ..... F01P 5/02; B60K 11/04

[52] U.S. Cl. ..... 165/41; 165/51; 123/41.49; 180/68.4

[58] Field of Search ..... 165/41, 44, 51, 122, 165/124; 123/41.49; 180/68.1, 68.4

[56] References Cited

U.S. PATENT DOCUMENTS

| | | | |
|---|---|---|---|
| D. 240,613 | 7/1976 | Thomas et al. | D12/8 |
| 2,897,802 | 8/1959 | Haas | 123/41.49 |
| 3,096,844 | 7/1963 | Sittel et al. | 180/79.2 |
| 3,519,156 | 7/1970 | Magnuson | 214/777 |
| 3,786,891 | 1/1974 | Vogelaar et al. | 180/68.4 |
| 3,868,992 | 3/1975 | Getz et al. | 165/51 |
| 3,885,643 | 5/1975 | Goodbary | 180/89 |
| 3,921,603 | 11/1975 | Bentz et al. | 165/51 |
| 4,160,487 | 7/1979 | Kunze et al. | 180/68.4 |
| 4,190,265 | 2/1980 | Goodbary et al. | 280/716 |
| 4,202,296 | 5/1980 | Nonnenmann et al. | 123/41.49 |
| 4,542,785 | 9/1985 | Bagnall et al. | 165/41 |
| 4,757,858 | 7/1988 | Miller et al. | 165/41 |
| 4,766,968 | 8/1988 | Matsunaga | 180/68.4 |
| 4,821,828 | 4/1989 | Schwertzler et al. | 180/68.4 |

*Primary Examiner*—John Rivell
*Assistant Examiner*—L. R. Leo
*Attorney, Agent, or Firm*—Head & Johnson

[57] ABSTRACT

A reduced noise modular cooling system for a large engine powered off-road machine formed of a modular superstructure mountable on and removable as a unti from a machine, air cooled radiator protions affixed to the superstructure front and opposed sides, a floor and hood closing the superstructure top and bottom and a fan panel closing the superstructure rear, the panel having one or preferably two fan shroud openings therein, thereby forming a plenum chamber within the interior of the superstructure, a fan rotatably supported by the superstructure within each of the fan shroud openings and a drive shaft extending from the machine engine for driving each of the fans to evacuate air from the plenum chamber and thereby to cause air to flow through the radiator portions and couplings for connecting fluid circulation through the radiator portions to the vehicle engine. Noise reduction is achieved by the increased radiator area accomplished by the wrap-around radiator portions which extend at least on three sides of the plenum formed in the superstructure, and by providing space to operate two smaller fans at a slower speed compared to one single large fan. The entire unit can be assembled and tested prior to installation in a machine and can be removed as a unit for service and repair, thereby reducing overall cost.

4 Claims, 3 Drawing Sheets

REDUCED NOISE MODULAR COOLING SYSTEM

BACKGROUND OF THE INVENTION

Large off-road machines are utilized in construction and mining industries for moving large volumes of earth or ore. The following U.S. Patents illustrate and describe examples of large off-road earth and ore hauling machines: U.S. Pat. Nos. Des. 240,613; 3,519,156; 3,885,643; 3,096,844; and 4,190,265.

In recent years increased attention has been given to overcoming environmental problems encountered with such large machines. One common problem that is receiving increased attention at this time is machine noise. It has been determined that a primary factor in the noise generated by such large land machines arises from radiator fans. The typical large off-road machine has a cooling system similar to that utilized on automobiles or trucks, that is, a vertical planar radiator core with a large diameter fan mounted close to the core with a shroud around the fan for moving air directly through the radiator. The use of such large diameter fans cause substantial noise since, in order to draw sufficient air through the radiator to cool the engine of such large machines, the fan tip speed results in substantial noise. In addition, the volume of air movement that is required through such a radiator system itself is a source of significant noise. With presently used machine cooling systems the horsepower requirements are high. This energy loss could otherwise be applied to vehicle performance improvements and/or fuel economy.

An additional problem encountered with typical cooling systems employed on large off-road machines is that the cooling system components are mounted as separate components on the machine. Since in existing systems the individual parts are separately mounted it is difficult to fabricate, assemble and test a cooling system prior to installation on a machine.

The basic objective of the present disclosure is to provide a modular cooling system for large engine powered machines that has advantages over the systems presently employed, including, as primary advantages, noise and horsepower loss reductions. In addition to noise reduction, other advantages of the modular radiator system for large machines of this disclosure are: (a) to reduce overall manufacturing costs; (b) to reduce horse power demands by the fan or fans and in so doing provide more power for useful work; (c) to provide a cooling modular system that can be completely fabricated, assembled and tested prior to installation on a machine; (d) to provide a cooling modular system that can be removed as a unit from a machine for service and repair; and (e) to provide a modular radiator system that can be used on a variety of machine sizes to thereby reduce inventory requirements compared to individualized cooling system units as presently employed.

SUMMARY OF THE INVENTION

The present disclosure is for a modular cooling system for large off-road machines having, among other objectives, overall noise reduction. The modular cooling system is formed of a superstructure having a bottom, a top, opposed sides, a front and a rear. The superstructure may be formed of structural metal, such as angle-iron, channels and so forth, and is preferably fabricated to provide a generally rectangular structure, although the superstructure is not necessarily exclusively of rectangular cross-sectional shape. Provision is made to removably mount the superstructure on a machine frame, such as by the utilization of mounting bolts also extending through shock absorption rubber grommets, the bolts extending through brackets formed as a part of the machine frame. Such mounting system provides for expeditious placement of the modular cooling system onto a machine frame or removing it from the machine for service or repair.

Air cooled radiator portions are affixed to the superstructure front and opposed sides, providing a wraparound arrangement. Floor and hood panels are employed to close the bottom and top of the superstructure. Either the floor panel or hood panel provide provision for access to the interior of the superstructure and facilities for the mounting of air conditioning coils or other items as required.

A fan panel closes the superstructure rear. The fan panel has at least one but preferably two spaced apart openings therein. Thus, with the radiator portions front, top and rear panels, an enclosed plenum chamber is provided within the interior of the superstructure.

Fans are rotatably supported by the superstructure within each of the fan shroud openings. In the preferred arrangement two fan openings are provided with a fan mounted in each opening. The utilization of two fans, rather than the typical single fan with the commonly employed radiator system, affords the opportunity to move greater volumes of air at reduced fan-tip velocities to thereby achieve overall cooling system noise reduction.

A drive shaft extends from the engine to the superstructure. Pulleys on the shaft receive belts for driving the fans.

The modular system preferably includes eye bolts affixed to the top portion thereof. The eye bolts provide means for lifting the modular assembly into position for mounting onto a machine or removing it from a machine for service or repair.

The modular cooling system is preferably mounted to the machine frame with shock absorbers. This can be accomplished by the use of brackets extending from the machine frame with resilient pads, such as large, thick rubber washers positioned between the modular system and the frame, or the use of large rubber grommets received in openings in the machine brackets. The shock absorption mounting of the modular system further serves to reduce noise originating from the cooling system.

A better understanding of the invention will be had by reference to the following description and claims, taken in conjunction with the attached drawings.

DESCRIPTION OF THE PREFERRED EMBODIMENT

Figure 1:
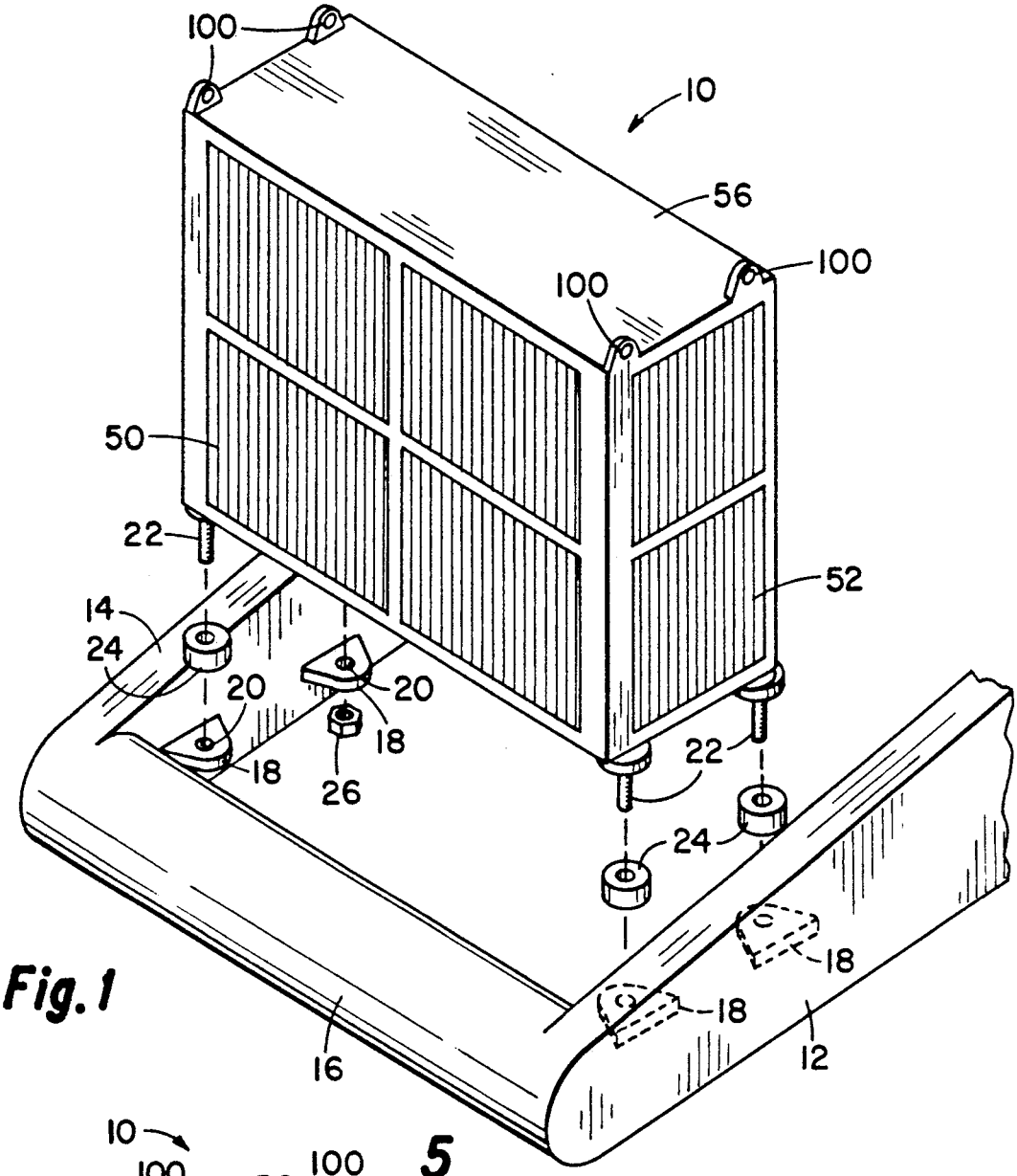
FIG. 1 is an isometric view showing a portion of the front end of a machine superstructure and showing a modular cooling system of this invention in position for mounting onto the machine superstructure.

Referring to the drawings and first to FIG. 1, a modular cooling system for a large engine powered machine, having among other advantages reduced noise, is generally indicated by the numeral 10. The modular cooling system is shown in exploded view with respect to the front end portion of the frame of a large off-road machine, the frame consisting of longitudinal structures 12 and 14, and a front cross member 16. The modular cooling system 10 is mounted onto and demountable from the machine frame and this can be accomplished in a variety of ways. In the method illustrated, the machine frame has structural brackets 18 extending from the cross members 12 and 14, each of the brackets having an opening 20 therein. Downwardly extending from the modular cooling system 10 are bolts 22 that receive shock absorption members, indicated as elastomeric washers 24 thereon. The bolts extend through washers 24 and through openings 20 and are retained by nut 26, only one of which is illustrated. Thus, the modular cooling system 10 is easily mounted onto or demountable from a machine frame and preferably in an arrangement including the use of a shock absorption system exemplified by the elastomeric washers 24. Obviously, other types of shock absorption systems may be employed, such as the use of large rubber grommets or the like.

Figure 2:
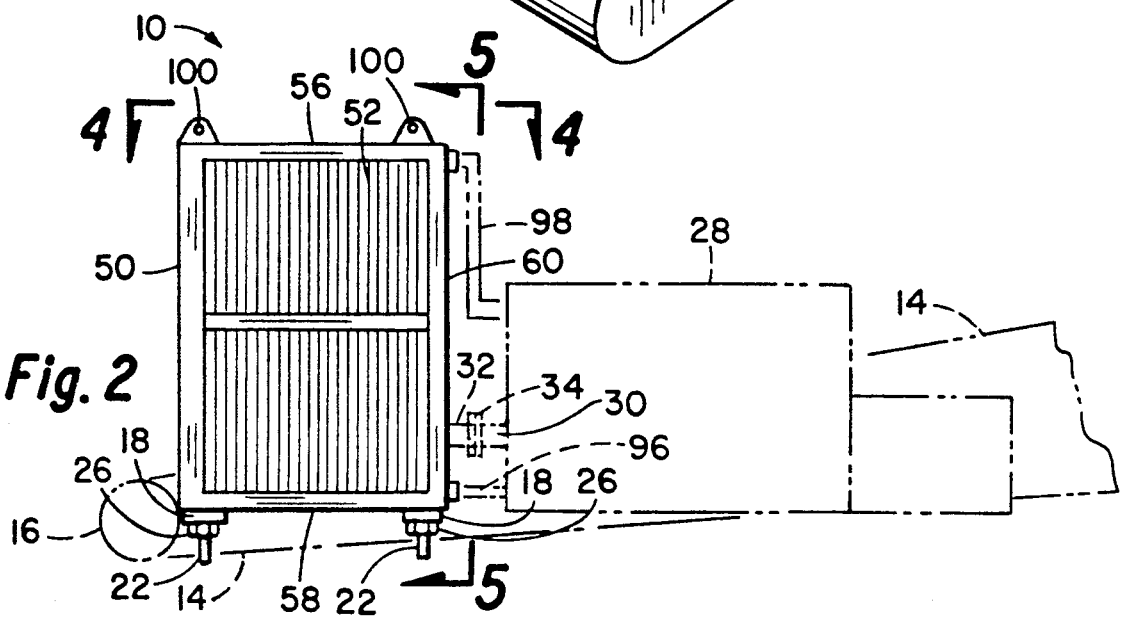
FIG. 2 is an elevational side view of the modular cooling system of FIG. 1, showing the machine frame in dotted outline and with the machine engine represented by a box structure in dotted outline and showing means of connecting the modular cooling system to the machine frame and to the machine engine.

FIG. 2 shows the modular system 10 in relation to the machine engine 28. The engine has, extending from the forward end thereof, a drive shaft 30. The modular cooling system 10 has extended from it a fan drive shaft 32. By means of a flange system 34, engine drive shaft 30 and fan drive shaft 32 can be expeditiously coupled together when the modular unit is installed on the machine or decoupled when it is necessary to remove the modular unit.

FIGS. 1 and 2 therefore establish the environment in which the modular cooling system of this invention is employed. Referring now to FIGS. 3-6 more details of the system will be understood.

Figure 3:
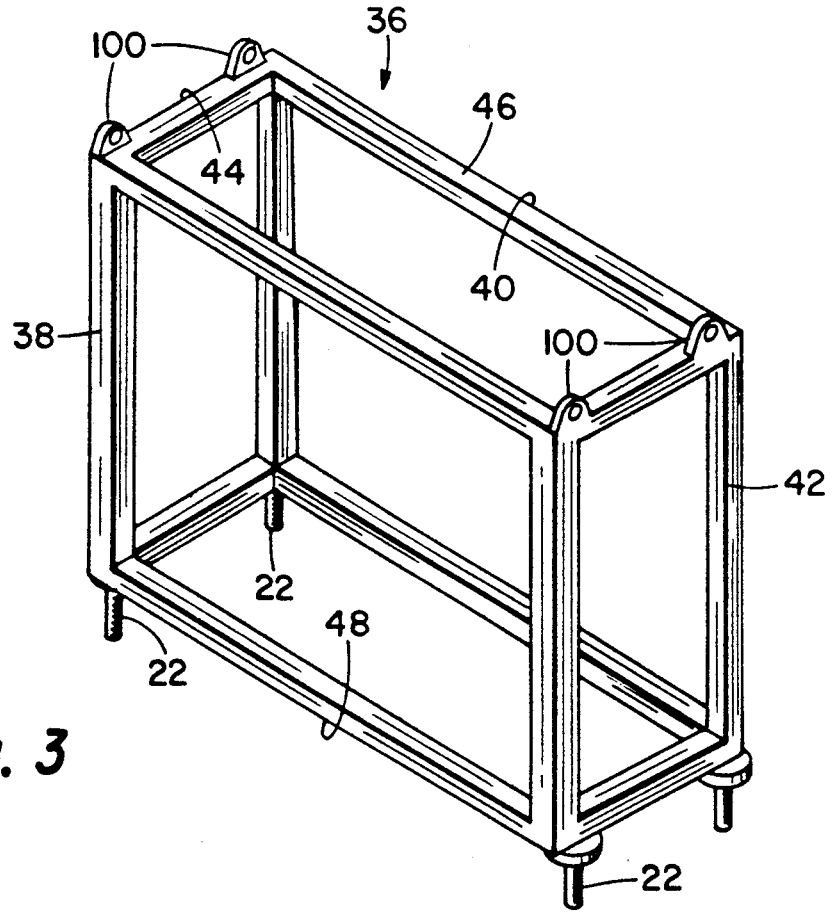
FIG. 3 is an isometric view of a superstructure for use in forming a modular cooling system.

FIG. 3 is an isometric view of the modular unit superstructure, generally indicated by the numeral 36, employed in the modular cooling system. The superstructure 36 may be formed of structural members, such as square tubing as illustrated, or may be formed of angles, channels or any other type of commonly employed structural elements utilized in industry. The superstructure 36 has a front surface 38, a rear surface 40, a first side surface 42, a second or side surface 44, a top surface 46, and a bottom surface 48.

Affixed to the front surface 38 is a radiator panel 50, as seen in FIG. 1. Affixed to the first side surface 42 is a side radiator panel 52, also seen in FIG. 1, and affixed to the opposite side surface 44 is an opposed second radiator panel 54 which is not seen in FIGS. 1 and 2 but is seen in dotted outline in FIG. 4, as will be subsequently described.

Each of the radiator panels consist of a radiator core having a number of rows of small diameter fluid carrying tubes supported by fin elements and arranged for air to pass therethrough and to permit exchange of heat between fluid and air in the system as all radiators commonly function.

The superstructure top surface 46 is closed by top panel 56, and the bottom surface 48 of the superstructure is closed by bottom panel 58.

Figure 4:
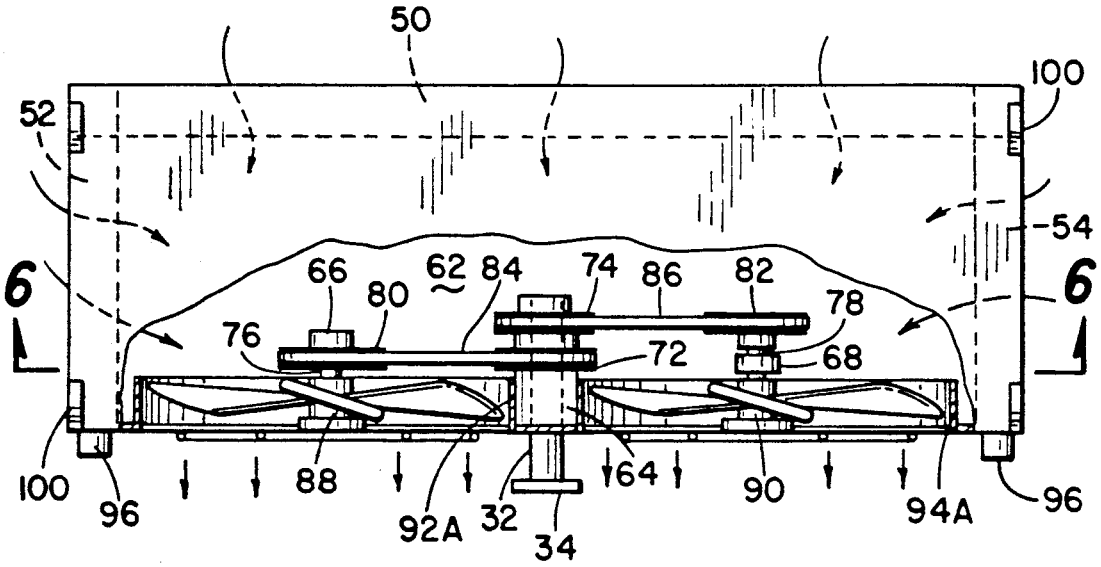
FIG. 4 is a top view as taken along the line 4—4 of FIG. 2, shown partially broken away, of the modular cooling system and showing, in partial cross-sectional view, the means of mounting the fans therein in the modular system.
Figure 5:
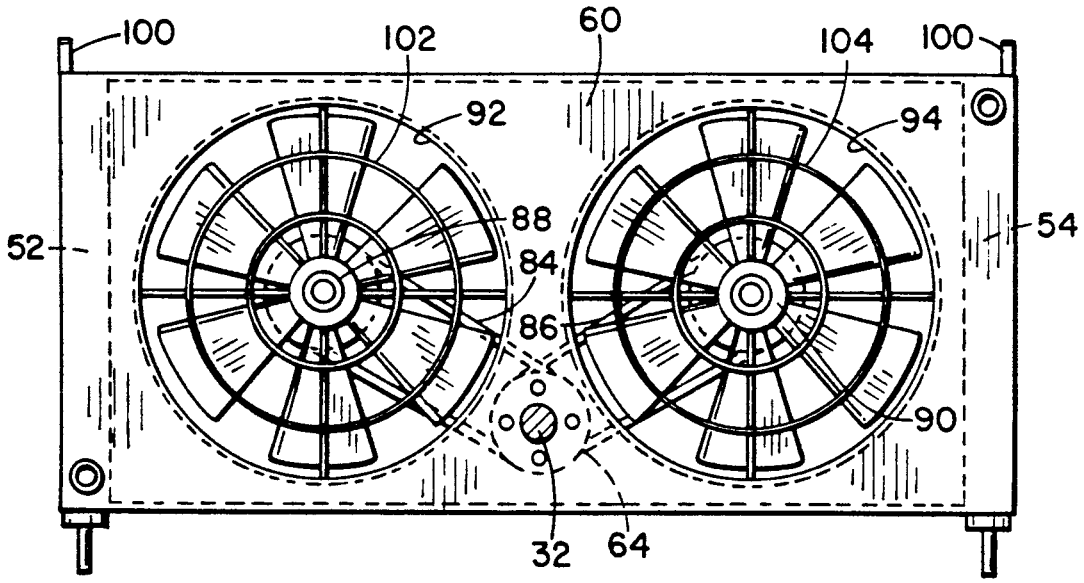
FIG. 5 is a rear view of the modular system as taken along the line 5—5 of FIG. 2 showing the fan panel and fans mounted therein.

The final surface of the superstructure, that is, the rear surface 40 is closed by a fan panel 60 as best seen in FIG. 5. Thus, the superstructure is closed on all six sides thereby forming a plenum chamber 62 within the interior of the superstructure. (See FIG. 4).

Figure 6:
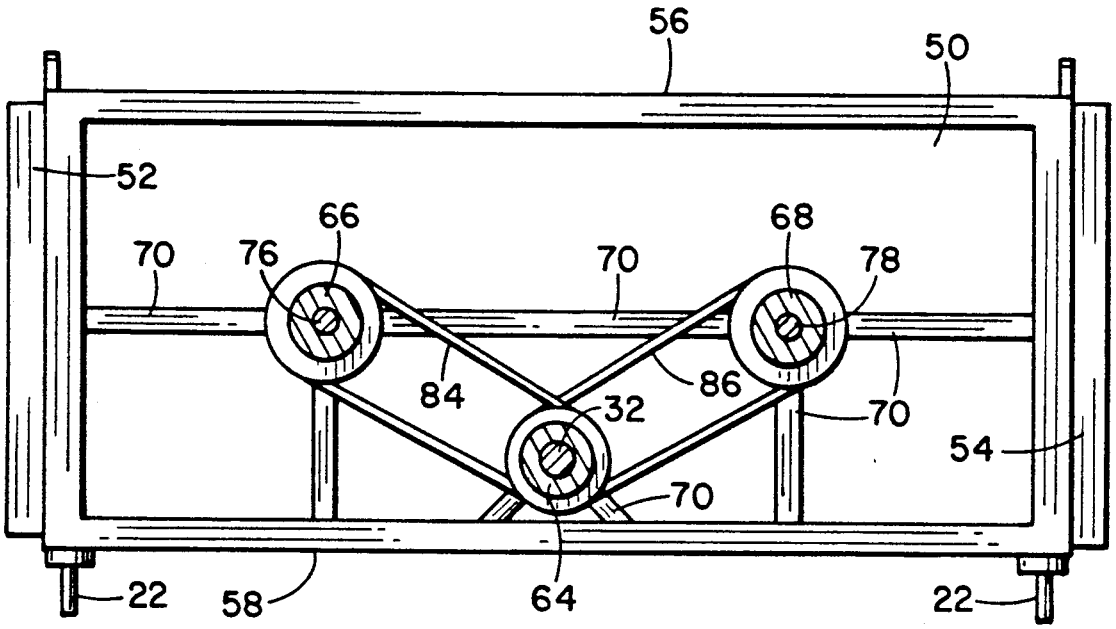
FIG. 6 is a cross-sectional view taken along the line 6—6 of FIG. 4 showing the interior of the superstructure with means to support the fan drive shaft hub and the fan hubs.

As shown in FIG. 6, there is positioned within the interior of the superstructure a drive shaft hub 64 that rotatably supports the fan drive shaft 32. In addition, in the illustrated and preferred embodiment, the modular cooling system 10 employs the use of two fans as contrasted with the common use of a single radiator fan, the advantages of which will be described subsequently. When two fans are employed as illustrated, there is positioned within the interior of the superstructure a first fan hub 66 and a second hub 68. The hubs 64, 66, and 68 are supported by structural members 70 within the superstructure 36. The structural members 70 are illustrated emblematically as the hubs can be supported in a variety of different ways. As shown in FIG. 4, fan drive shaft 32 has affixed to it a first pulley 72 and a second pulley 74. First fan hub 66 rotatably supports a first fan shaft 76 and in like manner, second fan hub 68 rotatably supports a second fan shaft 78. Attached to the first fan shaft 76 is a first fan pulley 80, and attached to the second fan shaft 78 is a second fan pulley 82. A first fan belt 84 extends from first pulley 80 to the fan drive pulley 72, and a second fan belt 86 couples the second fan drive shaft pulley 74 to the second fan pulley 82. Thus, when the fan drive shaft 32 is rotated, fan drive shafts 76 and 78 are rotated.

Affixed to the first fan shaft 76 is a fan 88 having a plurality of blades extending therefrom and in like manner, a second fan 90 is affixed to the second fan drive shaft 78.

Fan panel 60, as shown in FIGS. 4 and 5, has a first shroud opening 92 that receives first fan 88 and a spaced apart second fan shroud opening 94 which receives second fan 90.

The wrap-around radiator system which includes the radiator units 50, 52 and 54 are coupled to the engine by means of hoses 96 and 98 as shown in FIG. 2, as a means of circulating cooling fluid from engine 28 through the radiator system. The radiators units 50, 52 and 54 may be arranged in series or parallel to circulate one fluid stream from and back to the engine or the radiator system may be separately arranged to circulate different fluids, such as separate fluid systems for cooling engine 28 and for cooling engine transmission or other components, not illustrated.

The modular radiator system 10 is arranged so that it can be fully assembled and tested before installation onto the machine. Installation is facilitated by the use of lift hooks 100 as shown in FIGS. 1, 2 and 3. In addition, when it is necessary to replace or repair any components of the cooling system, the entire assembly can be expeditiously removed as a unit to greatly facilitate the repair.

It can be seen that by use of a modular system as illustrated herein the same system can be adapted to a variety of machines thereby reducing the duplication of components required on a series of different machine sizes.

The modular system achieves economy of construction and assembly, as well as providing a means of saving time and expense in repair and servicing. An important feature is the fact that the modular system provides for reduced noise. By the employment of two spaced apart fans as illustrated herein, compared to a single fan, the fan-tip velocities can be reduced while moving an equal or greater quantity of air. Further, by the use of a plenum chamber and a wrap-around design, the air velocities can be controlled so that the total sound volume of the cooling system is substantially reduced, compared to a single vertical front radiator with a single fan as commonly employed.

As seen in FIGS. 4 and 5 the modular cooling system includes fan safety guards 102 and 104. As shown best in FIG. 4, fan panel 60 includes, around each of fan openings 92 and 94, a circumferential shroud portion 92A and 94A respectively.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. A modular cooling system for a large engine powered machine having a machine frame, comprising:

an upright modular superstructure having a horizontal bottom, a horizontal top, opposed vertical sides, a vertical front and a vertical rear;

means to removably mount said superstructure on a machine frame whereby the superstructure front is oriented in the forward direction of travel of the machine;

vertical air cooled radiator portions affixed to said superstructure front and opposed sides;

a floor closing said superstructure bottom;

a hood closing said superstructure top;

a vertical fan panel closing said superstructure rear, the panel having at least one fan shroud opening therein, a plenum chamber being thereby formed within said superstructure;

a fan rotatably supported by said superstructure within each said at least one fan shroud opening in said fan panel, air being expelled from said plenum chamber by and through said fan to create a reduced differential air pressure within said plenum chamber, air flowing into said plenum chamber through each of said three radiator portions, the differential air pressure within said plenum chamber being equally applied to each of said three radiator portions;

means connected to the machine engine for driving each said fan to evacuate air from said plenum chamber; and means for circulating at least one fluid from the machine engine through said radiator portions.

2. A modular cooling system according to claim 1 wherein said means to removably mount said superstructure on a machine frame includes resilient shock absorption means.

3. A modular cooling system according to claim 1 wherein said fan panel has two shroud openings therein and a said fan vertically rotatably supported in each shroud opening.

4. A modular cooling system according to claim 1 wherein said vertical fan panel has a first and a second fan shroud opening therein and wherein said engine powered machine has a horizontal extending engine drive shaft and including:

a horizontal fan drive shaft rotatably supported to said modular structure having a first and a second pulley thereon;

means to rotatably couple said fan drive shaft to said engine drive shaft;

a first fan hub supported to said modular structure within said first fan shroud opening and rotatably supporting a first fan shaft therein;

a second fan hub supported to said modular structure within said second fan shroud opening and rotatably supporting a second fan shaft therein;

a fan and a pulley affixed to said first fan shaft;

a fan and a pulley affixed to said second fan shaft;

a first belt encompassing said first pulley on said drive shaft and said pulley affixed to said first fan shaft; and a second belt encompassing said second pulley on said drive shaft and said pulley affixed to said second fan shaft whereby both said fans are rotated by said horizontally extending engine drive shaft.

* * * * *

UNITED STATES PATENT AND TRADEMARK OFFICE

CERTIFICATE OF CORRECTION

PATENT NO. : 5,065,814

DATED : Nov. 15, 1991

INVENTOR(S) : Loeber et al

It is certified that error appears in the above—identified patent and that said Letters Patent is hereby corrected as shown below:

ON THE TITLE PAGE:
Number 57, Abstract, Line 3, change "unti" to --unit--

Signed and Sealed this

Thirteenth Day of April, 1993

*Attest:*

STEPHEN G. KUNIN

*Attesting Officer*

*Acting Commissioner of Patents and Trademarks*

UNITED STATES PATENT AND TRADEMARK OFFICE

CERTIFICATE OF CORRECTION

PATENT NO. : 5,065,814

DATED : November 19, 1991

INVENTOR(S) : FREDERICK W. LOEBER AND George O. GREENE

It is certified that error appears in the above-identified patent and that said Letters Patent is hereby corrected as shown below:

Column 1, line 49, change"cooling modular" to --modular cooling--.
line 51, change" cooing modular" to --modular cooling--.

Signed and Sealed this

Sixteenth Day of November, 1993

*Attest:*

Bruce Lehman

BRUCE LEHMAN

*Attesting Officer*

*Commissioner of Patents and Trademarks*